US005863268A

United States Patent [19]

Birch

[11] Patent Number: 5,863,268

[45] Date of Patent: Jan. 26, 1999

[54] METAL GOALKEEPER'S HOCKEY STICK

[76] Inventor: Thomas George Birch, 1315 Boughbeeches Blvd., Apt. 1701, Mississauga, Ontario, Canada, L4W 4A1

[21] Appl. No.: 583,556

[22] Filed: Jan. 5, 1996

[30] Foreign Application Priority Data

Mar. 7, 1995 [CA] Canada ..... 2144121

[51] Int. Cl.[6] ..... A63B 59/14

[52] U.S. Cl. ..... 473/563; 473/562

[58] Field of Search ..... 273/67 A

[56] References Cited

U.S. PATENT DOCUMENTS

| | | | |
|---|---|---|---|
| 2,912,245 | 11/1959 | Gardnar et al. | 273/67 A |
| 3,377,066 | 4/1968 | Trowbridge | 273/72 |
| 3,529,825 | 9/1970 | White | 273/67 A |
| 3,863,917 | 2/1975 | Beale | 273/67 |
| 3,961,790 | 6/1976 | Milligan | 273/67 |
| 4,013,288 | 3/1977 | Goverde | 273/67 |
| 4,076,240 | 2/1978 | Haddad | 273/67 A |
| 4,124,208 | 11/1978 | Burns | 273/67 A |
| 4,222,562 | 9/1980 | Gardner | 273/67 |
| 4,340,224 | 7/1982 | Staats | 273/67 A |
| 4,361,325 | 11/1982 | Jansen | 273/67 A |
| 4,651,990 | 3/1987 | Profit | 273/67 |
| 5,127,649 | 7/1992 | Carbonero | 273/67 |
| 5,294,113 | 3/1994 | Cadouceur et al. | 273/67 A |
| 5,312,100 | 5/1994 | Ilacqua et al. | 273/67 A |
| 5,429,352 | 7/1995 | Leclerc | 273/67 A |

FOREIGN PATENT DOCUMENTS

| | | | |
|---|---|---|---|
| 633295 | 12/1961 | Canada | 273/67 A |
| 1206497 | 6/1986 | Canada . | |
| 2046366 | 1/1993 | Canada . | |
| 2078254 | 1/1993 | Canada . | |
| 2067087 | 10/1993 | Canada . | |
| 1259467 | of 0000 | United Kingdom . | |

*Primary Examiner*—Mark S. Graham
*Attorney, Agent, or Firm*—Young & Basile, P.C.

[57] ABSTRACT

An ice hockey stick comprising a blade and an elongate, narrow handle connected to a top end of the blade. The handle and blade are formed from a strong, lightweight metal such as aluminum alloy. The blade has a number of relatively small holes extending through it for purposes of weight reduction. These holes are distributed over the surface of the blade. Preferably the handle is detachably connected to the blade. A preferred embodiment is for a goalkeeper and, in this version, the blade has an ice engaging portion and an upstanding portion which extends at an obtuse angle to the ice engaging portion. The holes are distributed over both portions of the blade.

9 Claims, 2 Drawing Sheets

METAL GOALKEEPER'S HOCKEY STICK

BACKGROUND OF THE INVENTION

The present invention relates to the field of ice hockey sticks.

In playing the game of hockey, whether on ice, asphalt or other surface, a great deal of stress is placed on hockey sticks which are typically employed to project a relatively heavy, e.g. 250 gram, hockey puck at speeds approximating 150 km/h. Other stresses may also be applied to hockey sticks, such as the stress imposed upon the blade portion of the stick by players who slap the ice or ground when taking a shot or handling the puck. In addition, goalie sticks often receive significant blows from high speed pucks and from players who barrel into the goalkeeper at breakneck speed in an attempt to score a goal. These and a myriad of other stresses imposed on hockey sticks in the game of hockey result in a relatively short lifespan for the hockey stick. Consequently, a player may need to purchase many hockey sticks in a season, which costs may be exacerbated when the hockey stick in question is a goalkeeper's stick.

A number of prior art patents address the problem of making the typically wooden hockey stick stronger and/or less prone to breakage.

U.S. Pat. No. 4,013,288 issued Mar. 22, 1977 to Goverde discloses a hockey stick made primarily from foamed nylon mixed with glass fiber. In one embodiment, the stick is reinforced with an aluminum frame which is embedded in the blade. The reinforcement is provided with pierced openings for reducing the weight thereof, and to help bond the plastic material with the reinforcement.

U.S. Pat. No. 4,651,990 issued Mar. 24, 1987 to Profit discloses a protective device for a goalkeeper's stick which is most useful for protecting the stick during practice sessions. This device is in the shape of a channel having a base and upstanding front and rear panels for engaging the blade. The rear panel of this device includes a number of openings therein in order to reduce the weight of the device. The device can be held on the stick by means of tape.

Published Canadian application number 2,078,254 describes a blade protector that can be made in one or two pieces and that fits on the bottom of a hockey stick blade. In this manner, the blade may be protected from ground abrasions such as occur when playing road hockey.

U.K. patent No. 1,259,467 issued Jan. 5, 1912 to M. Cunningham describes a plastic hockey stick that has a handle portion with a metal stiffening member embedded therein. In addition, hockey sticks which have an aluminum shaft and a wooden blade insert are currently available for sale in a variety of establishments. However, there are oftentimes explicit warnings at the point of sale that such sticks are not guaranteed against breakage.

The problem with the prior art is that while certain advances have been made with respect to strengthening the hockey stick, these advances have been minimal. To date, there is no hockey stick which, when used normally, can be considered virtually indestructible.

SUMMARY OF THE INVENTION

According to one aspect, the present invention provides a goaltender hockey stick comprising an elongate, relatively narrow handle that is connected to a blade at its top end, wherein the handle and blade are formed from a strong, lightweight metal or metal alloy. The blade portion has an ice engaging portion and an upstanding portion, which extends at an obtuse angle to the ice engaging portion, and has a number of relatively small holes extending through the blade for reducing the weight of the stick. These holes are distributed over the surface of the blade. A protective sheath fits over a bottom portion of the blade in order to protect it from the ground abrasions. In the preferred embodiment of the invention, the hockey stick is an aluminum alloy goalkeeper's stick.

Preferably, removable fastening screws are employed to join the handle and blade together thereby allowing ease of transport and permitting either component to be replaced as desired. By constructing the goalkeeper's stick from aluminum alloy, and by providing weight reducing holes therein, the stick can weigh very close to the weight of a wooden stick of the same size, yet be a strong and long-lasting stick that can be produced at a reasonable cost.

According to another aspect of the invention, a goaltender hockey stick comprises a blade having an ice engaging portion and an upstanding portion, which extends at an obtuse angle to the ice engaging portion. The blade has a number of through holes distributed over its surface in order to reduce the weight of the blade, these holes being substantially smaller in width than the diameter of a standard hockey puck. A protective wear strip is provided for connection to a bottom edge of the ice engaging portion. Fasteners detachably connect the wear strip to the bottom edge. An elongate handle is connected to a top end of the upstanding portion of the blade. Both the blade and said handle are made substantially from a strong, lightweight metal or metal alloy. A butt is fastened to the upper portion of the handle and this butt has a recess adapted to hold a tool for tightening a fastening member used to connect the handle to the blade.

According to a further aspect of the invention, the through holes in the blade include a series of relatively large holes and a series of smaller holes, the larger holes being positioned centrally of the blade in the transverse direction thereof.

The present invention will be understood and appreciated more fully from the following detailed description, taken in conjunction with the accompanying drawings.

DETAILED DESCRIPTION OF PREFERRED EMBODIMENTS

Figures 1, 2, 3:
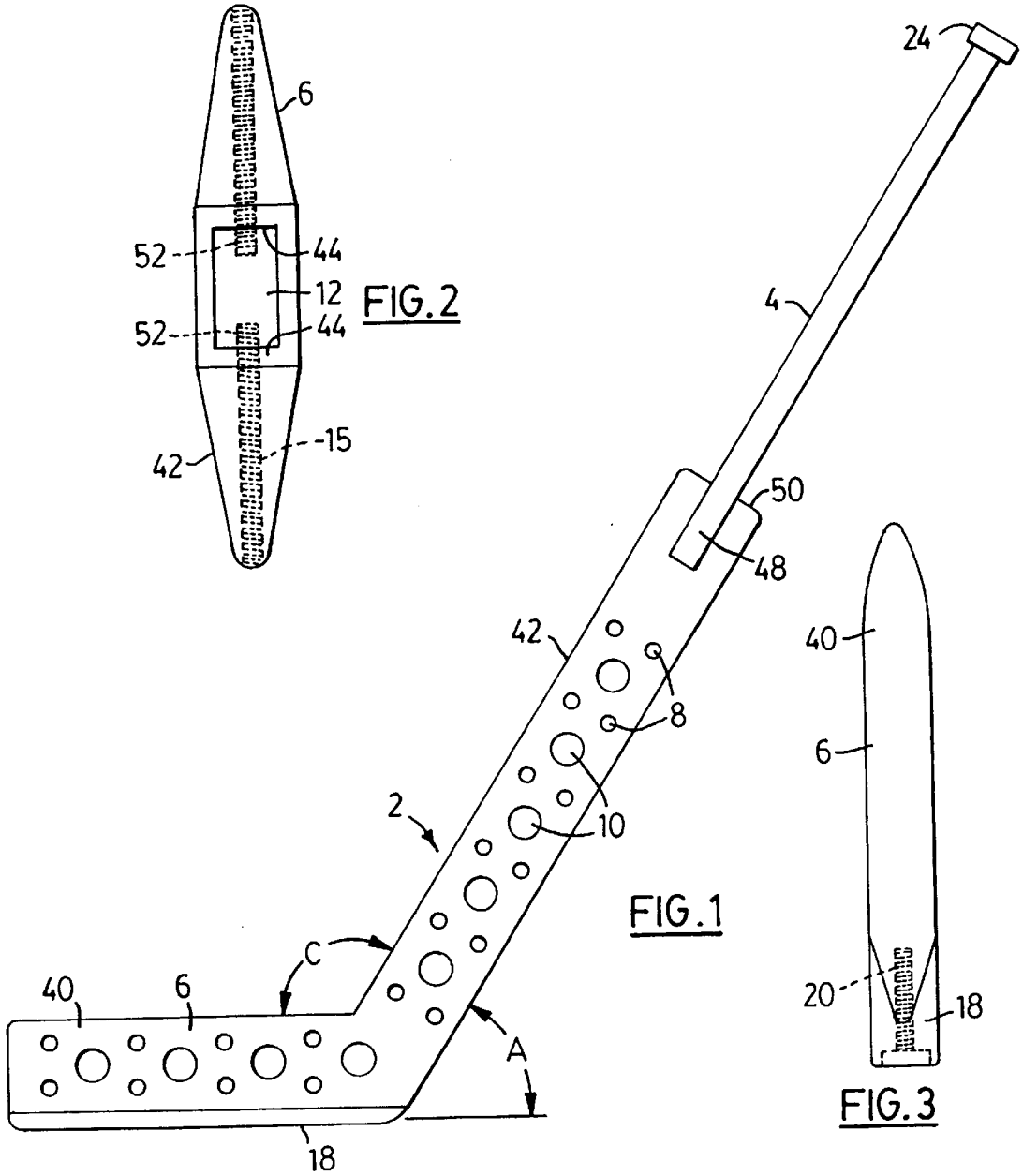
FIG. 1 is a side view of a goalie stick according to a preferred embodiment of the invention.
FIG. 2 is a top end view of a blade portion of the stick shown in FIG. 1.
FIG. 3 is a front end view of the blade portion of the stick shown in FIG. 1.

FIG. 1 depicts a goalie stick 2, which comprises a preferably tubular, elongate rectangular handle 4 that is mated to a top end of a blade 6. The tubular handle 4 and blade 6 are formed from a lightweight metal or metal alloy, such as an aluminum alloy, thereby providing a remarkably strong and difficult to break hockey stick. Preferably the blade is constructed of solid aluminum alloy while the handle is hollow. Of course, other lightweight metal alloys, such as titanium alloy or an alloy comprising 50% aluminum and 50% titanium, could be used in alternative constructions of the stick 2 but aluminum alloy is advantageous from a cost standpoint.

In the goalkeeper's stick 2, the blade is extended in a known manner so that it has both a horizontally extending portion 40 and a vertical or upstanding portion 42 that extends upwardly at an acute angle indicated at A, to the horizontal plane when the stick is held upright in a vertical plane. The portion 40 is the ice-engaging portion and the portion 42 extends at an obtuse angle C to the ice-engaging portion. In one preferred embodiment, the length of the portion 40 along its bottom edge is 15 inches and its height is 3.5 inches. In this embodiment, the length of the upstanding portion 42 measured from the heel is 26 inches.

A number of relatively small through holes 8 and/or a number of larger holes 10 are formed in the blade 6 thereby reducing the weight of the stick 2 (as compared to the situation where no holes are present). These holes are evenly distributed over the surface of the blade including the portion 42 that extends upwardly at an angle. The holes 8 and 10 are, of course, small enough to not have any significant effect with respect to the contact between the blade 6 and a hockey puck or the like. Note that all of these holes are substantially smaller than the diameter of a standard hockey puck. In one preferred stick, the holes 8 have a diameter of ½ inch and the holes 10 have a diameter of 1½ inches.

Figure 5:
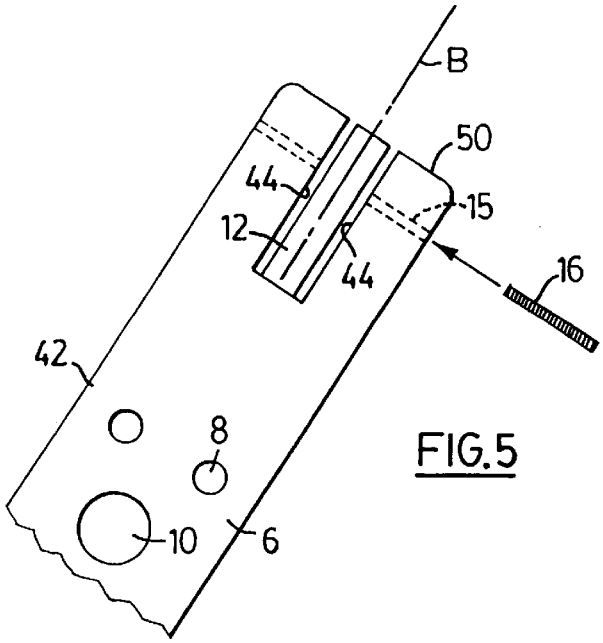
FIG. 5 is a side view detail of the upper end portion of the blade portion.

In the preferred embodiment of the invention, the handle 4 is a hollow tubular shaft of the usual length for a goalie's stick, for example about 32 inches. It can have the usual cross-sectional dimensions, for example 1"×⅝th". For mating the handle 4 to the blade 6, a connecting pin 12 is formed at the top end of the upstanding portion 42 of the blade (see FIG. 5). This pin, which is preferably rectangular in cross-section, has a central axis indicated at B that is substantially normal to the top end 50 of the blade 6 and is sized so as to telescope into a bottom end portion of the handle 4. At least one, and preferably two threaded holes 15 extend perpendicularly from two handle receiving slots 44 and through the blade 6, as shown in FIG. 2 and 5. Fastening members 16, such as set screws, are employed to fasten the handle 4 to the blade 6 via holes 15. The bottom end portion 48 of the handle has holes to receive the inner ends of the set screw 16 and these holes are aligned with the threaded holes 15 when the handle is fully mounted on the blade. Also, the pin 12 can have aligned holes 52 (which may be threaded) to receive the inner ends of the set screws 16.

The aforementioned pin-fastening method for mating the handle 4 to blade 6 is, of course, not the only method which may be employed. A variety of metal part mating methods as known in the art per se may be employed with alternative embodiments of the present invention. Examples of these methods include: welding, casting or cutting the blade and shank as one piece, etc. The handle and blade need not be detachable but can be formed as one integral piece.

Figure 4:
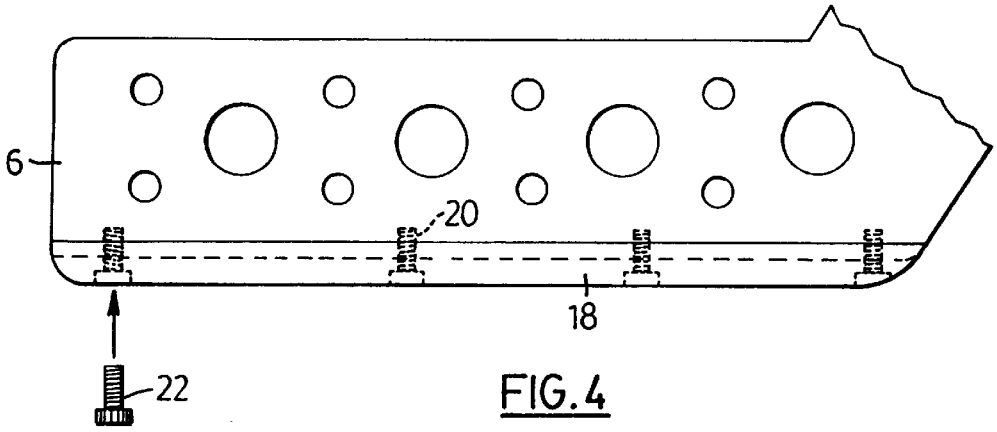
FIG. 4 is a side view of the bottom edge portion of the stick.

Referring now to FIGS. 1, 3 and 4, a blade protector or wear strip 18, preferably in the form of a rigid plastic-type sheath, can be optionally attached to the blade 6. The protector 18 prevents the ground-contacting edge of the blade 6 from ground abrasion which the stick 2 normally encounters when the stick is used on pavement or concrete. The preferred plastic material for this wear strip is nylon but other tough plastics could be used. The protector 18 is preferably fastened to the blade 6 by means of cap screws 22 (one of which is shown prior to attachment) which can be screwed into threaded openings or screw holes 20 formed within the blade. Thus, the protector 18 is easily removable when not required and can be intermittantly replaced whenever required. The protector 18 would not normally be used on an ice surface. In one embodiment of the invention, the screw holes 20 are spaced apart 4 to 5 inches with the two end holes being positioned about one inch from the adjacent end of the protector 18.

Figure 6:
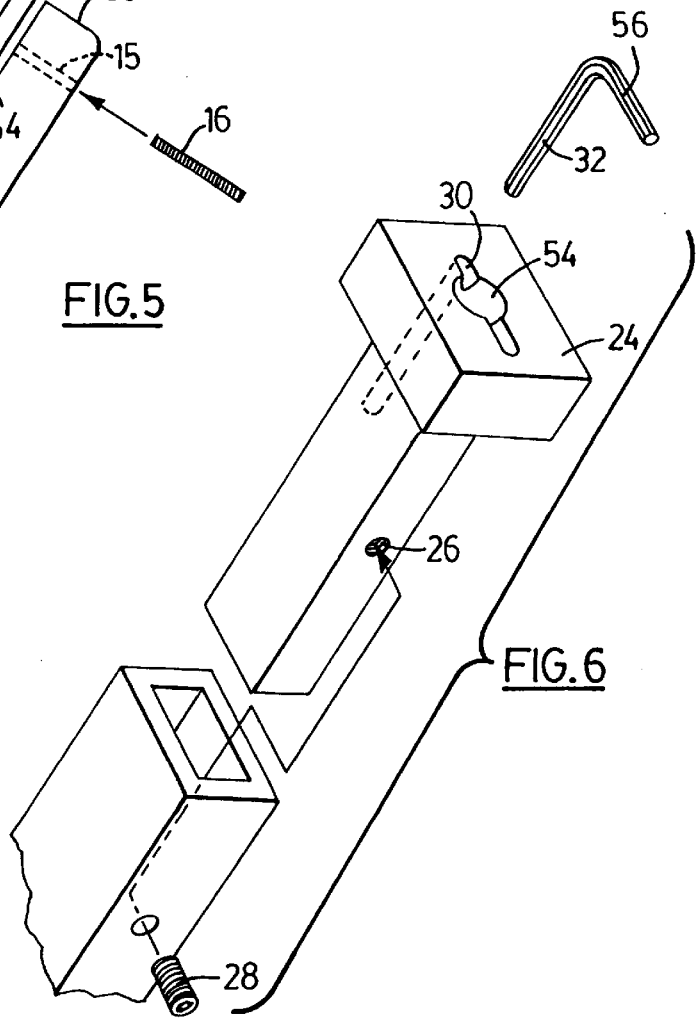
FIG. 6 is a perspective view of a butt end portion of the stick shown in FIG. 1.

Referring to FIG. 6, a butt 24, preferably of plastic or hard rubber and preferably T-shaped, is lodged into the upper part of the handle 4. In one preferred version the butt has a width or diameter of 1½ inch and a height measured in the lengthwise direction of the handle of 3 inches, including the portion of the butt that extends into the handle. A fastening member, such as set screw 28, fastens the butt 24 to the end of the handle. In addition, the butt 24 is preferably formed with a recess 30 which is designed to hold an Allen key 32 or the like. This feature conveniently allows the player to carry with him at all times the tool used to remove or tighten the various set screws and the like utilized in disassembling or assembling the stick. The recess 30 can be extended at 54 on each side to permit the end of a finger to be inserted under the short portion 56 of the key.

It will be appreciated that the stick 2, as described hereinabove, is a strong stick which, in combination with the blade protector 18, should provide the player with a goalkeeper's stick that will last for many seasons. At the same time, this stick is not unduly heavy for use by a goalkeeper.

It will also be appreciated that the holes 8 and 10 can be a variety of shapes including square, diamond and, as illustrated, circular. In one preferred embodiment, the larger holes 10 are positioned centrally of the blade in the transverse direction thereof.

The stick of the invention can be made by several different, known, metal forming methods including die casting and stamping. A metal extrusion process can also be employed, particularly for the tubular metal handle.

In a preferred version of the present hockey stick the holes 8 and 10 are spaced as follows:

| | | |
|---|---|---|
| Between adjacent holes 8 | = | 3¼ inches |
| From front end of blade to first set of holes 8 | = | 1½ inches |
| Distance from top or bottom edge of blade to centre of hole 8 | = | ⅞ inch |
| Distance from top edge of blade at top of upstanding portion to first holes 8 | = | 6.5 inches |

It will be appreciated by persons skilled in the art that the present invention is not limited by what has been particularly shown and described herein. Rather, the scope of the present invention is defined only by the claims which follow.

I therefore claim:

1. A goaltender hockey stick comprising:

a blade having an ice engaging portion and an elongate upstanding portion, which extends at an obtuse angle to the ice engaging portion;

a protective sheath for fitting over a bottom edge of said blade in order to protect said blade from ground abrasions;

means for detachably connecting said sheath to said bottom edge of the blade;

an elongate, relatively narrow handle which is connected to a top end of the blade; and a butt fastened to a an upper portion of the handle, said butt having a recess adapted to hold a tool for tightening a fastening member used to detachably connect said handle to said blade, wherein the blade is constructed of strong, solid lightweight metal or metal alloy, the blade having a number of relatively small holes extending through the blade, said holes being distributed over the surface of the blade, and the handle is substantially formed from a strong, lightweight metal or metal alloy.

2. A hockey stick according to claim 1 including:

a connecting pin arranged substantially normal to the top end of said blade and inserted into a bottom end portion of said handle;

at least one hole in said bottom end portion of said handle; and at least one threaded hole in a top end portion of said blade, this hole being aligned with the at least one hole in the handle so as to allow a threaded fastener in said at least one threaded hole to enter the hole in the handle.

3. A hockey stick according to claim 1 wherein said blade includes a plurality of screw holes and said connecting means comprises screws.

4. A goaltender hockey stick comprising:

a blade having an ice engaging portion and an upstanding portion, which extends at an obtuse angle to the ice engaging portion;

an elongate, relatively narrow handle which is connected to a top end of the blade, such handle being substantially formed from a strong, lightweight metal or metal alloy; and a butt fastened to an upper portion of the handle, the butt having a recess adapted to hold a tool for tightening a fastening member used to detachably connect said handle to said blade, wherein said blade is constructed of strong, solid lightweight metal or metal alloy and has a number of relatively small holes extending through the blade, said holes being distributed over the surface of the blade.

5. A hockey stick according to claim 4 wherein said handle and blade are formed of an aluminum alloy.

6. A hockey stick according to claim 7 wherein said small holes are distributed over the length of the blade including the length of said upstanding portion.

7. A goaltender hockey stick comprising:

a blade having an ice engaging portion and an upstanding portion, which extends at an obtuse angle to the ice engaging portion, said blade having a number of through holes distributed over its surface in order to reduce the weight of the blade, said holes being substantially smaller in width than the diameter of a standard hockey puck, said through holes in the blade including a series of relatively large holes and a series of smaller holes, said larger holes being positioned centrally of the blade in the transverse direction thereof and an elongate handle connected to a top end of said upstanding portion of the blade, wherein said blade is constructed of strong, solid lightweight metal or metal alloy and said handle is made substantially from a strong, lightweight metal or metal alloy.

8. A goaltender hockey stick according to claim 7 wherein said handle has a bottom end portion which telescopes over a pin mounted rigidly at said top end of the upstanding portion and is secured thereto by at least one threaded fastener.

9. A goaltender hockey stick according to claim 7 including several threaded openings formed in a bottom edge of said ice engaging portion for the purpose of detachably connecting a wear strip to said ice engaging portion.

* * * * *